US005154496A

United States Patent [19]

Campbell et al.

[11] Patent Number: 5,154,496

[45] Date of Patent: Oct. 13, 1992

[54] ROLL TOWEL CABINET MOUNTING SYSTEM

[75] Inventors: William E. Campbell, Antioch; Craig D. Yardley, Walnut Creek, both of Calif.

[73] Assignee: James River II, Inc., Oakland, Calif.

[21] Appl. No.: 698,935

[22] Filed: May 13, 1991

[51] Int. Cl.[5] ..... B65H 49/00

[52] U.S. Cl. ..... 312/34.8; 221/199

[58] Field of Search ..... 312/37, 38, 242, 245; 211/6, 16; 29/401.1; 225/16, 42; 221/47, 48, 49, 199

[56] References Cited

U.S. PATENT DOCUMENTS

| | | | |
|---|---|---|---|
| 3,147,051 | 9/1964 | Birr et al. | 312/37 |
| 3,597,032 | 8/1971 | Harangozo | 312/37 |
| 4,408,811 | 10/1983 | Richardson et al. | 312/37 |
| 4,425,012 | 1/1984 | Kley | 312/37 |

*Primary Examiner*—Kenneth J. Dorner
*Assistant Examiner*—Brian K. Green
*Attorney, Agent, or Firm*—Thomas R. Lampe

[57] ABSTRACT

A roll towel dispenser is attached to a folded towel dispenser housing by removing a cover from the housing, replacing the cover with an adaptor plate, inserting the roll towel dispenser into an aperture defined by the housing and adaptor plate, and supporting the roll towel dispenser on a partition in the housing interior.

4 Claims, 7 Drawing Sheets

ROLL TOWEL CABINET MOUNTING SYSTEM

TECHNICAL FIELD

This invention relates to a system for mounting a roll towel dispenser cabinet on a wall. More particularly, the system of the present invention includes an apparatus and method utilized to convert or retrofit an in-the-wall folded towel dispenser to accommodate a roll towel dispenser.

BACKGROUND ART

In-the-wall folded paper towel dispensers are well-known fixtures commonly found in the rest rooms of office buildings, restaurants and other commercial settings. Commonly, such in-the-wall dispensers have a housing including interconnected top, bottom, side and rear walls defining an interior, a partition located between the side walls and dividing the interior into an upper interior portion adapted to retain a stack of folded towels therein and a lower portion, and a cover connected to at least one of the housing walls for enclosing the upper interior portion.

The present invention provides for the ready conversion of a folded towel dispenser of the aforegoing nature into a roll paper towel dispenser. This is accomplished in an expeditious manner without having to remove the housing from the wall to which it is attached. While various schemes have been devised for replacing wall mounted folded towel dispensers with roll paper towel dispensers, such arrangements are generally characterized by their relative complexity and high expense, both with regard to the equipment itself and its installation. Also, prior art devices do not readily lend themselves to use with housings of varying sizes. In other words, insofar as prior art retrofit roll paper towel cabinets are concerned, they are usually designed for use with one particular housing size. The present invention, on the other hand, readily permits use of more than one roll paper towel cabinet size with a particular in-the-wall housing.

DISCLOSURE OF INVENTION

The present invention relates to both apparatus and a method. According to the method, an in-the-wall folded towel dispenser of the above-described type is retrofitted to provide for the dispensing of roll towel products, rather than folded towels. Conversion is accomplished quickly and with a minimum of installation time and effort. Different sized roll paper towel dispensers may be selectively installed in a standard single size in-the-wall housing and still present an aesthetically pleasing appearance.

The folded towel dispenser to be retrofitted has a housing including interconnected top, bottom, side and rear walls defining an interior. A partition is located between the side walls and divides the interior into an upper interior portion adapted to retain a stack of folded towels therein and a lower portion. A cover is connected to at least one of the housing walls for covering the upper interior portion.

According to the method of the present invention, the cover is removed from the housing. The cover is replaced with a front plate smaller than the cover. The front plate and the housing define an aperture of a predetermined size and configuration, said aperture communicating with the upper interior portion.

Next, a roll towel dispenser is inserted in the aperture. The roll towel dispenser is then brought into engagement with the partition. The partition supports the roll towel dispenser. The roll towel dispenser is retained in the aperture and in engagement with the partition.

The apparatus of the present invention is the structural combination which is the end product of the aforedescribed method. More particularly, the apparatus of the present invention includes a folded towel dispenser housing including interconnected top, bottom, side and rear walls defining an interior. The housing additionally includes a partition located between the side walls and dividing the housing interior into an upper interior portion adapted to retain a stack of folded towels therein and a lower interior portion. The partition defines an aperture providing communication between the upper and lower interior portions.

The structural combination additionally includes a roll towel dispenser including a cabinet for accommodating at least one roll towel therein and for dispensing the roll towel. The roll towel dispenser additionally includes attachment means projecting from the rear of the cabinet and positioned in the upper interior portion of the housing and in engagement with the partition. The partition and the attachment means are cooperable to retain the roll towel dispenser in the housing.

The structural combination additionally includes adaptor plate means and connector means connecting the adaptor plate means to the housing. The adaptor plate is in engagement with the roll towel dispenser when the roll towel dispenser attachment means is in engagement with the partition. The adaptor plate means is of a size and configuration to at least partially surround the roll towel dispenser and cooperate with at least some of the folded towel dispenser housing walls to enclose the upper interior portion.

Other features, advantages and objects of the present invention will become apparent with reference to the following detailed description and the accompanying drawings.

PREFERRED MODES FOR CARRYING OUT THE INVENTION

Figure 1:
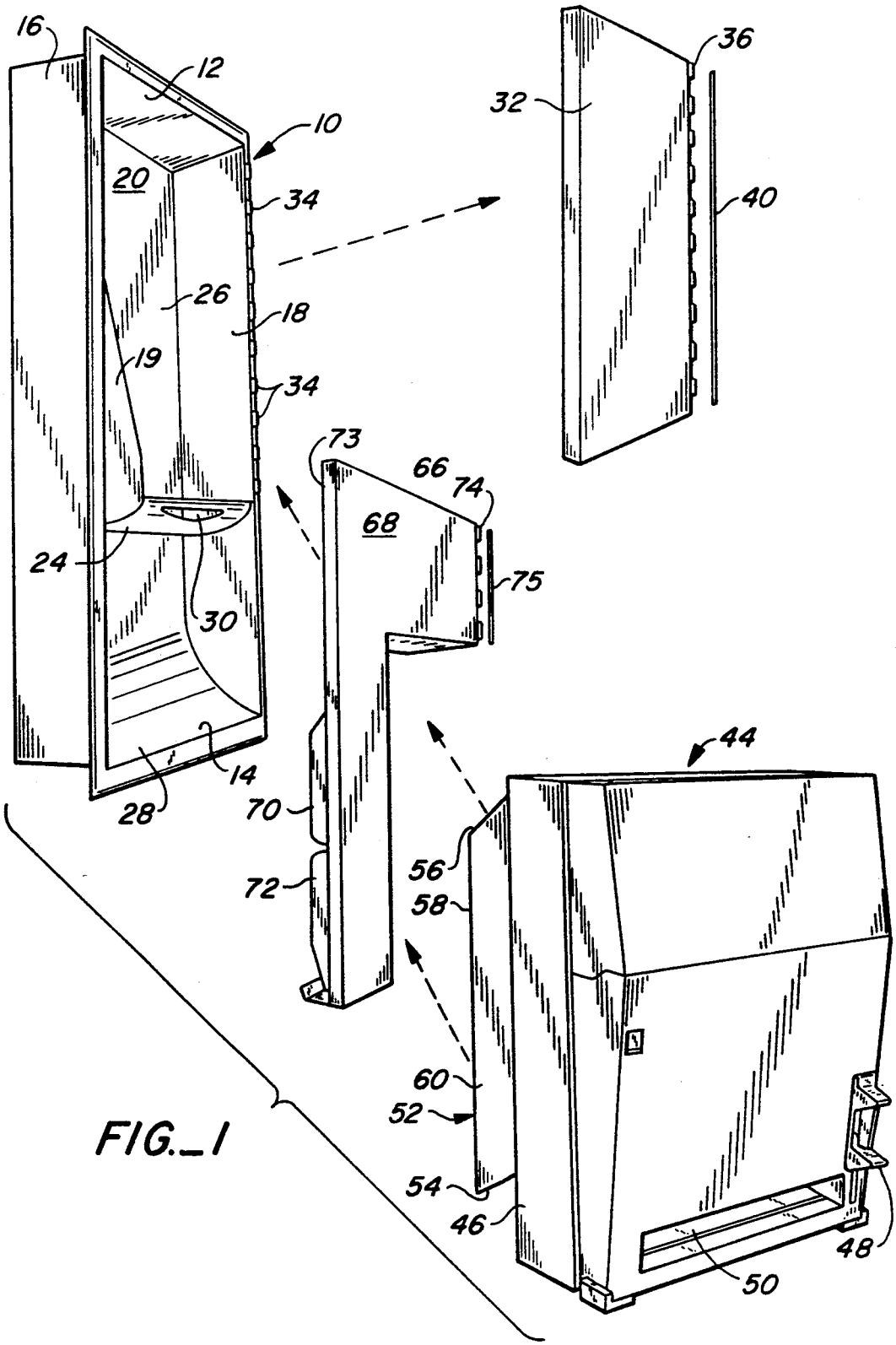
FIG. 1 is a perspective, exploded view of an in-the-wall folded paper towel dispenser with the cover removed from the housing, and a roll paper towel dispenser and adaptor plate means prior to application thereof to the folded paper towel dispenser housing.

Referring now to FIG. 1, reference numeral 10 designates a folded paper towel dispenser housing including a top wall 12, a bottom wall 14, outer side walls 16, 18, an inner side wall 19, and a rear wall 20.

A partition 24 is located between the side walls 18, 19 divides the interior of the housing into an upper interior portion 26 and a lower interior portion 28. The upper interior portion 26 is adapted to retain therein a stack of folded paper towels (not shown). In the embodiment shown, side walls 16, 19 define a space which may accommodate, for example, paper cups (not shown). The partition 24 defines an aperture 30 providing communication between the upper and lower interior portions. It will be appreciated that the aperture 30 is for the purpose of providing manual access to paper towels accommodated by the housing.

A cover 32 is normally connected to housing side wall 18 by hinge structure. More particularly, side wall 18 has spaced hinge elements 34 projecting outwardly therefrom. Hinge elements 34 mesh with hinge elements 36 formed on cover 32. It will be appreciated that, as is conventional, the hinge elements 34, 36 define openings which are in alignment when the hinge elements 34, 36 are intermeshed. An elongated linchpin 40 passes through all of said openings to secure the cover and side wall 18 together in hinged fashion.

The folded paper towel dispenser just described is a well-known construction, such often being formed of stainless steel sheet material.

For a variety of reasons, one may wish to replace a folded towel dispenser with a roll towel dispenser. Such a roll towel dispenser is designated generally by reference numeral 44. As is conventional, roll towel dispenser 44 includes a cabinet 46 for accommodating at least one roll towel (not shown) therein. Also, as is conventional, cabinet 46 incorporates therein suitable mechanism (not shown) which is actuated by a handle 48 to dispense a desired amount of the roll towel through access slot 50.

Roll towel dispenser 44 additionally includes attachment means 52 projecting from the rear of the cabinet. Attachment means 52 includes a bottom wall 54, a top wall 56, a back wall 58 and opposed side walls 60, 62. In the arrangement shown, the attachment means is essentially in the form of an auxiliary cabinet which defines an interior communicating with the interior of cabinet 46. That is, the attachment means 52 and cabinet 46 together define an interior space which can accommodate a larger roll towel than could be accommodated by cabinet 46 itself. Roll towel dispenser 44 is preferably formed of a material corresponding to that utilized in the construction of the folded paper towel dispenser housing 10. As stated above, a commonly used material is stainless steel sheeting.

Mounting roll towel dispenser 44 on housing 10 is a relatively simple matter. First, cover 32 is removed from the housing. This is accomplished by withdrawing linchpin 40 from hinge elements 34, 36. Removal of cover 32 completely exposes upper interior portion 26. Any stacked towels (not shown) within the upper interior portion are then removed.

Figure 2:
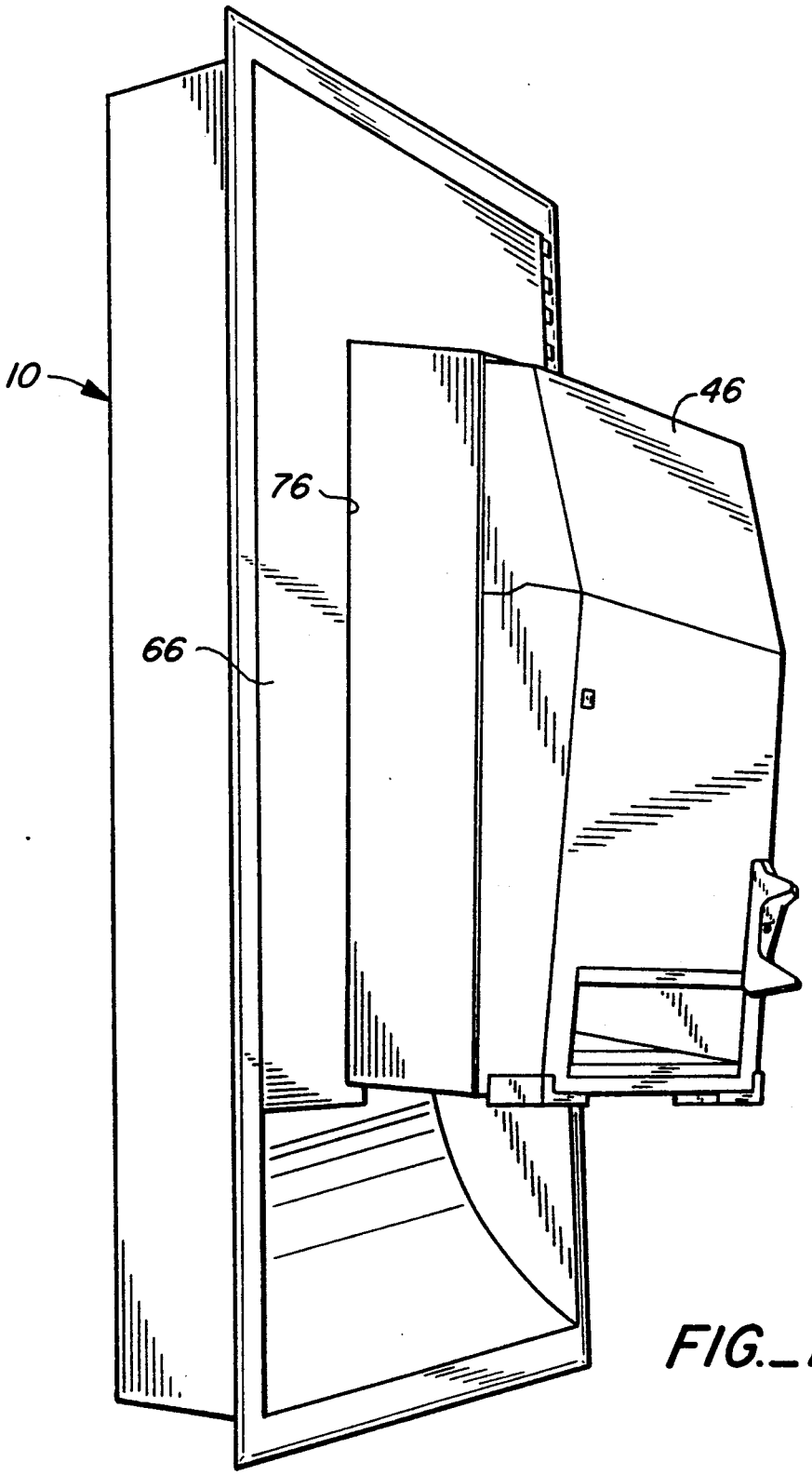
FIG. 2 is a perspective view illustrating the roll paper towel dispenser and adaptor plate means connected to the housing.
Figure 3:
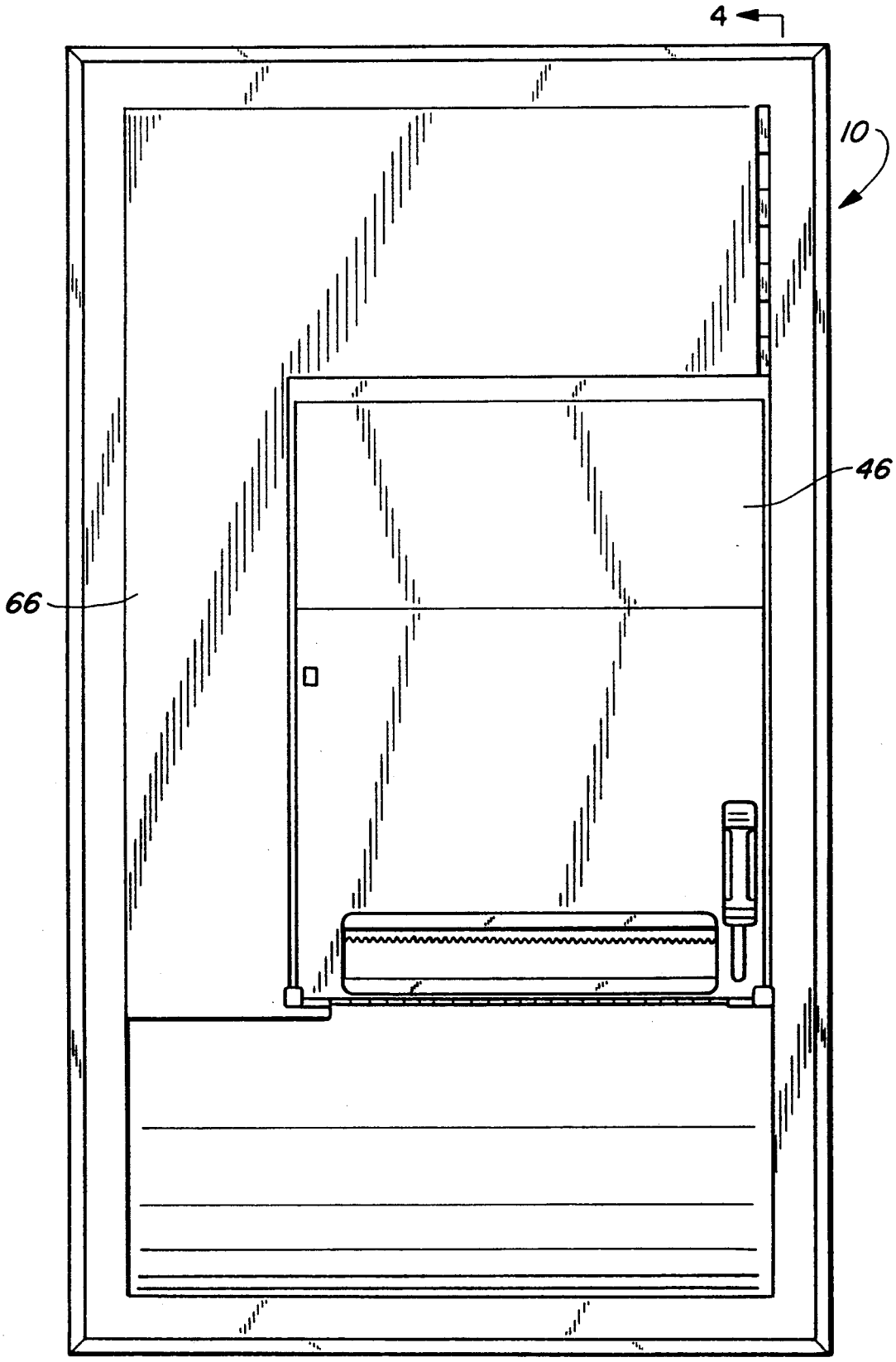
FIG. 3 is a frontal elevation view of the housing, roll paper towel dispenser and adaptor plate means in assembled condition.

Cover 32 is replaced by adapter plate means 66. Adapter plate means 66 includes a front plate 68 and flange elements, such as flange elements 70, 72, and 73 attached to the front plate. Hinge elements 74 of the same nature as hinge elements 34, 36 project from the front plate 68. When attaching adapter plate means 66 to the housing 10, hinge elements 74 are brought into alignment with certain of the hinge elements 34 of the housing, i.e. those hinge elements 34 disposed at the top of the housing, and linchpin 75 is inserted therethrough. When flange elements 70, 72 are positioned in the housing interior in face-to-face engagement with side wall 19, and flange element 73 is in face-to-face engagement with side wall 16, the adapter plate means 66 and the housing will define an aperture 76 (FIGS. 2 and 4) communicating with the upper interior portion 26.

Figure 4:
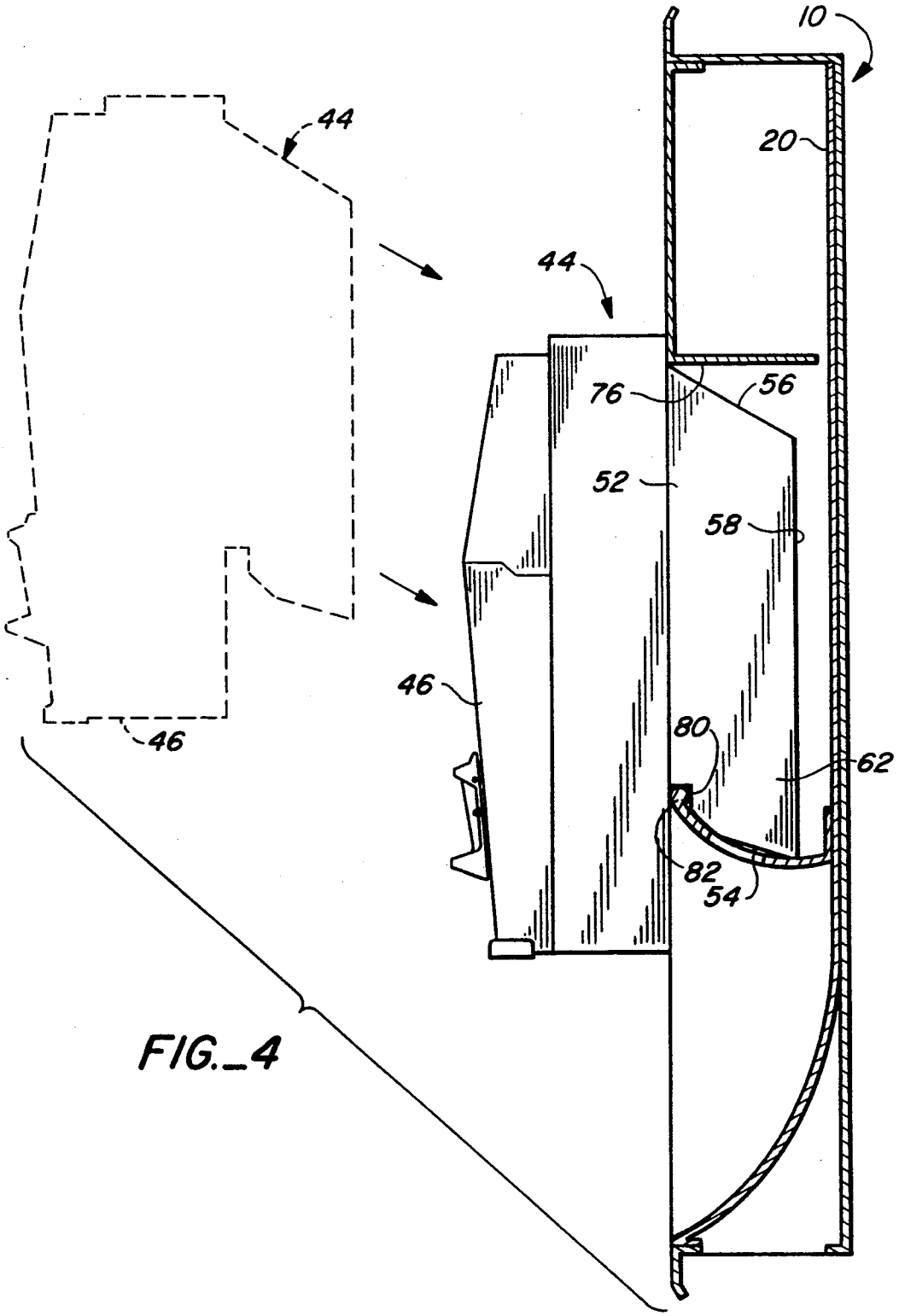
FIG. 4 is a cross-sectional view taken along line 4—4 in FIG. 3.

Next, the attachment means 52 of the roll towel dispenser is inserted in aperture 76 and brought into engagement with partition 24 in the manner shown in FIG. 4.

As can perhaps best be seen with reference to that figure, the bottom wall 54 of attachment means 52 is supported on partition 24 to provide positive support for the roll towel dispenser. Cabinet 46 is somewhat larger than aperture 76 so that the aperture will not be seen when observing the aforedescribed structure from the outside, thus presenting an aesthetically pleasing appearance.

In the arrangement illustrated, the attachment means 52 bottom defines a notch 80. Notch 80 accommodates an upwardly extending lip 82 formed on partition 24 and positioned away from the rear wall 20 of the housing. Thus, the notch 80 and lip are cooperable to retain the roll towel dispenser cabinet on the housing. One or more metal screws (not shown) are preferably employed to attach the cabinet 46 to housing 10, for example to side wall 18 thereof.

Figure 5:
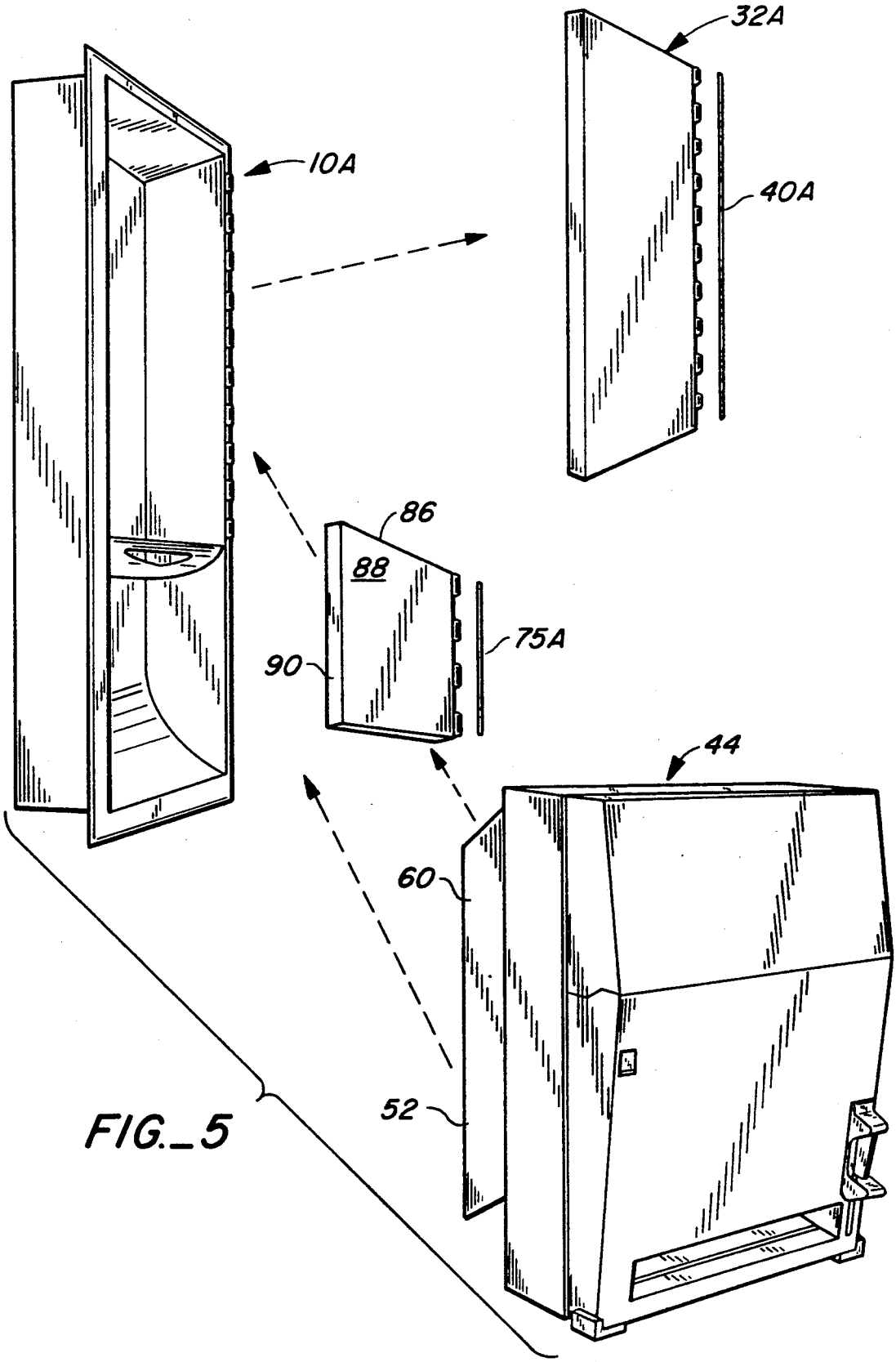
FIG. 5 is a view similar to that of FIG. 1, but illustrating an alternative embodiment of apparatus constructed in accordance with the teachings of the present invention.
Figure 6:
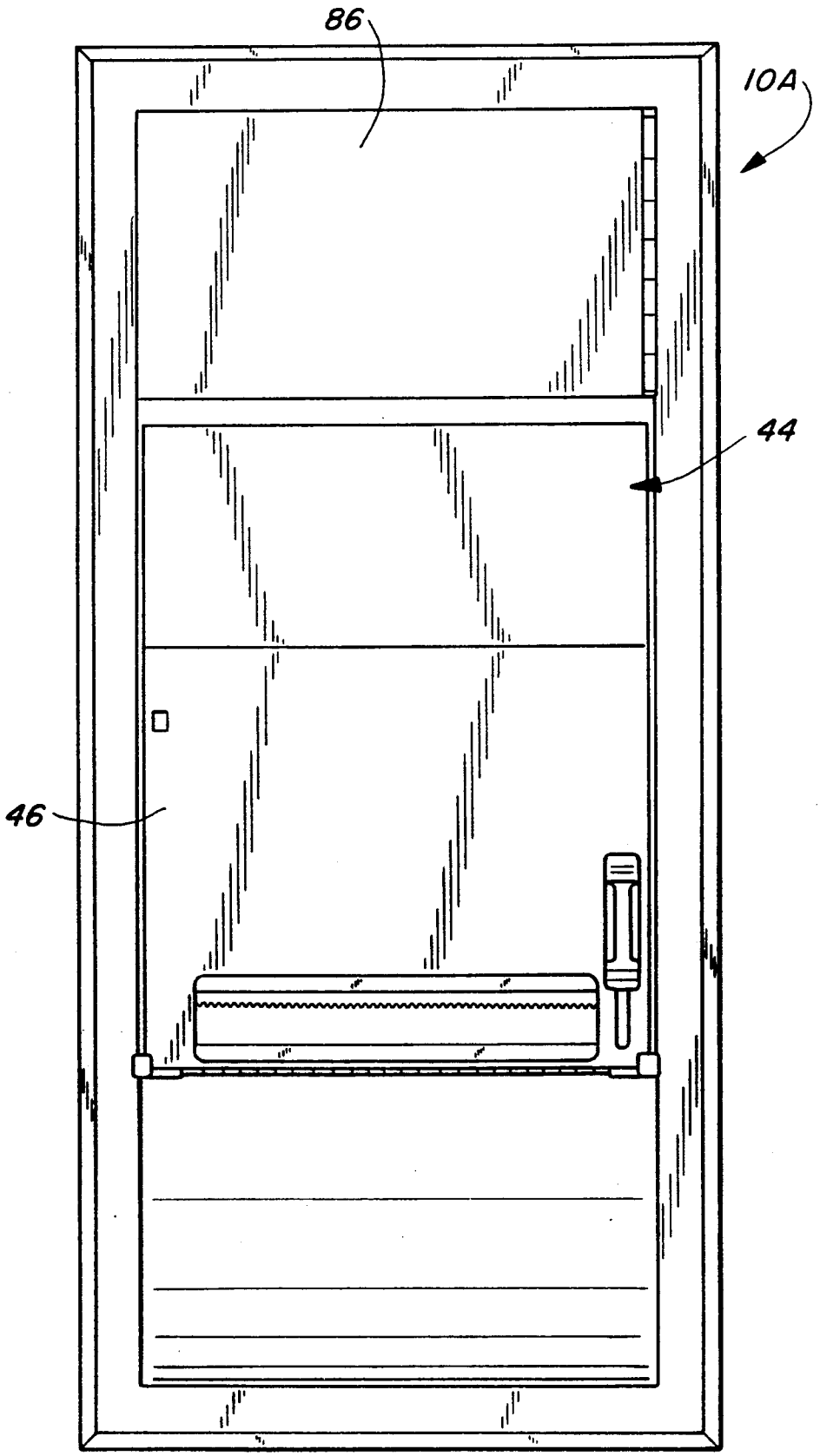
FIG. 6 is a view similar to FIG. 3 of the alternative embodiment illustrated in FIG. 5.
Figure 7:
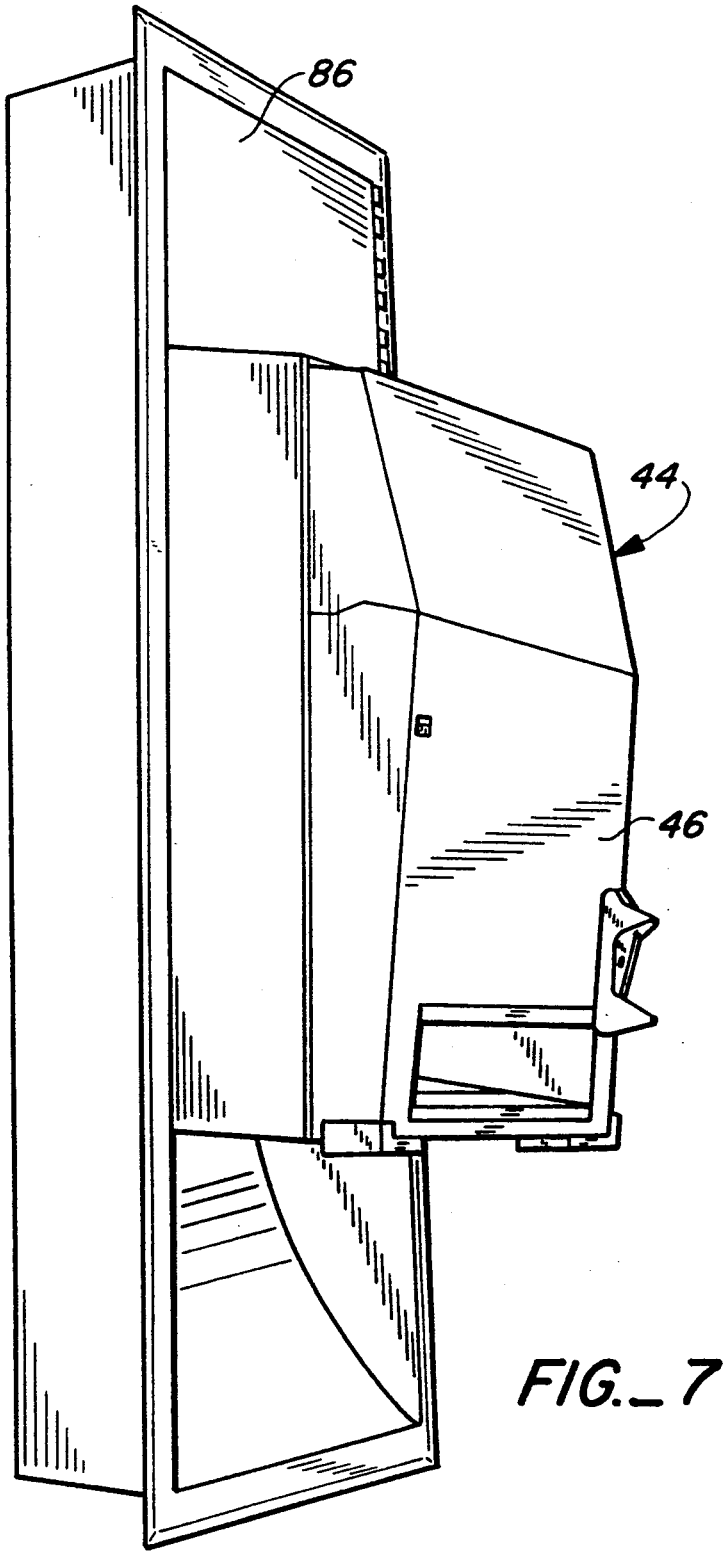
FIG. 7 is a view similar to FIG. 2 of the alternative embodiment illustrated in FIG. 5.

FIGS. 5–7 illustrate an arrangement similar to that of FIGS. 1–4 wherein the roll towel dispenser 44 is to be retrofitted onto a folded towel dispenser housing 10A. The only essential difference between housing 10 and housing 10A is that housing 10A is somewhat narrower in configuration and does not have an inner wall corresponding to inner wall 19 of housing 10. When cover 32A is removed as illustrated in FIG. 5, it is replaced by attachment means 86 including a front plate 88 and flange elements such as flange element 90.

It will be appreciated that in the arrangement shown in FIGS. 5–7 the distance between the housing 10A side walls 16A, 18A and the distance between side walls 60, 62 of the attachment means 52 is approximately the same. Therefore, adapter plate means 86 need only extend across the top of the attachment means 52 and not along a side wall. That is, while front plate 68 was of generally L-shaped construction, front plate 88 is of a rectangular shape. The attachment steps carried out with respect to housing 10A and roll towel dispenser 44 are the same as those carried out with respect to roll towel dispenser 44 and housing 10.

We claim:

1. Apparatus comprising, in combination:

a folded towel dispenser housing including interconnected top wall, bottom wall, side walls, and a rear wall defining an interior, and a partition located between said side walls and dividing said interior into an upper interior portion adapted to retain a stack of folded towels therein and a lower interior portion, said partition having an aperture formed therein providing communication between said upper and lower interior portions;

a roll towel dispenser including a cabinet for accommodating at least one roll towel therein and for dispensing said roll towel, said roll towel dispenser additionally including attachment means projecting from said cabinet and positioned in said folded towel dispenser housing upper interior portion and in engagement with said partition;

retention means for retaining said roll towel dispenser on said housing;

adaptor plate means in engagement with said roll towel dispenser when said roll towel dispenser attachment means is in engagement with said partition, said adaptor plate means being of a size and configuration to at least partially surround said roll towel dispenser and cooperable with at least some of said folded towel dispenser housing walls to partially enclose said upper interior portion; and connector means connecting said adaptor plate means to said housing, said attachment means having a bottom defining a notch, and said partition terminating at an upwardly extending lip positioned away from the rear wall of said housing, said lip being received by the notch and cooperable with said attachment means to retain said roll towel dispenser cabinet on said housing, said lip and notch at least partially comprising said retention means.

2. The apparatus according to claim 1 wherein said connector means includes hinge elements projecting from both said adaptor plate means and said housing and securement means for securing said hinge elements together in pivoting relationship.

3. The apparatus according to claim 2 wherein said securement means comprises an elongated linchpin extending through said adaptor plate means and housing hinge elements.

4. The apparatus according to claim 1 wherein said roll towel dispenser is smaller than said upper interior portion, said adaptor plate means including a front plate extending between said roll towel dispenser and at least some of said housing walls, and flange elements attached to said front plate and projecting into said housing interior and in engagement with at least some of said housing walls.

* * * * *